US006739567B1

(12) United States Patent
Curtis

(10) Patent No.: US 6,739,567 B1
(45) Date of Patent: May 25, 2004

(54) SEPARABLE MAGNETIC ATTACHMENT ASSEMBLY

(75) Inventor: Mark A. Curtis, Vancouver, WA (US)

(73) Assignee: Pacific Cascade Parking Equipment Corporation, Vancouver, WA (US)

( * ) Notice: Subject to any disclaimer, the term of this patent is extended or adjusted under 35 U.S.C. 154(b) by 8 days.

(21) Appl. No.: 10/270,790

(22) Filed: Oct. 11, 2002

(51) Int. Cl.[7] ..... F16M 13/00

(52) U.S. Cl. ..... 248/548; 248/206 S; 248/519; 248/529; 248/683; 248/909; 52/DIG. 4; 40/606.01; 40/607.01

(58) Field of Search ..... 248/909, 910, 248/548, 519, 529, 158, 206 S, 683; 52/165, DIG. 4; 40/607.01, 606.01

(56) References Cited

U.S. PATENT DOCUMENTS

| | | | | | |
|---|---|---|---|---|---|
| 3,349,531 | A | | 10/1967 | Watson | |
| 3,521,413 | A | * | 7/1970 | Scott | 52/98 |
| 3,552,073 | A | * | 1/1971 | Millerbernd | 52/98 |
| 3,563,502 | A | * | 2/1971 | Dayson | 52/98 |
| 3,572,223 | A | * | 3/1971 | Vierregger | 52/296 |
| 3,837,752 | A | * | 9/1974 | Shewchuk | 403/2 |
| 4,059,934 | A | | 11/1977 | Hayamizu | |
| 4,154,037 | A | * | 5/1979 | Anderson | 52/296 |
| 4,619,456 | A | | 10/1986 | Meggs | |
| 5,039,100 | A | | 8/1991 | Cortese | |
| 5,088,683 | A | * | 2/1992 | Briden | 248/548 |
| 5,160,111 | A | * | 11/1992 | Hugron | 248/548 |
| 5,282,963 | A | * | 2/1994 | Hull et al. | 210/223 |
| 5,481,835 | A | * | 1/1996 | Bloom | 52/98 |
| 5,558,455 | A | * | 9/1996 | Emery | 403/2 |
| 5,855,443 | A | * | 1/1999 | Faller et al. | 403/2 |
| 6,042,080 | A | | 3/2000 | Shepherd et al. | |
| 6,098,361 | A | | 8/2000 | Roten et al. | |
| 6,141,928 | A | * | 11/2000 | Platt | 52/296 |
| 6,199,814 | B1 | * | 3/2001 | Lee | 248/442.2 |
| 6,240,689 | B1 | * | 6/2001 | Haddad et al. | 52/298 |
| 6,250,835 | B1 | * | 6/2001 | Chamel | 403/2 |
| 6,289,636 | B1 | | 9/2001 | White et al. | |
| 6,305,656 | B1 | | 10/2001 | Wemyss | |
| 6,390,436 | B2 | * | 5/2002 | Barnes et al. | 248/548 |
| 6,422,783 | B1 | * | 7/2002 | Jordan | 404/9 |
| 6,427,965 | B1 | * | 8/2002 | McCracken | 248/633 |
| 6,457,895 | B1 | * | 10/2002 | Salman | 403/2 |
| 6,477,749 | B1 | * | 11/2002 | Reiter | 24/303 |
| 6,540,196 | B1 | * | 4/2003 | Ellsworth | 248/548 |

OTHER PUBLICATIONS

US 2002/0166275 (Broadwell et al.) Nov. 2002, "Universal Sign Holder".*

MMC Magnetics Corporation, "Standard Magnet Assemblies," Sep. 30, 2002, one page, ©2001.

* cited by examiner

*Primary Examiner*—Ramon O. Ramirez
*Assistant Examiner*—Amy J Sterling
(74) *Attorney, Agent, or Firm*—Christensen O'Connor Johnson Kindness PLLC

(57) ABSTRACT

Described is a removable assembly for use on a fixed surface. The assembly includes a post having a base (42) and an attachment assembly (8). The attachment assembly includes a base plate (10) and a magnet assembly (12), both capable of carrying a magnetic current. The magnet assembly includes a housing (20) and a magnet (22) disposed within the housing. To use, the magnet assembly is placed adjacent the base plate, the magnetic forces attracting and holding them together. The magnet is positioned apart from the base plate while the housing contacts the base plate to form the magnet circuit. An attachment plate (30) is connected to the housing upper wall adjacent its outer surface. The attachment plate includes one or more outwardly projecting attachment bolts (26). As assembled, the bolts engage corresponding openings (48) in the post base (42).

21 Claims, 4 Drawing Sheets

SEPARABLE MAGNETIC ATTACHMENT ASSEMBLY

FIELD OF THE INVENTION

The present invention relates to supports, and more particularly, to a frangible magnetic assembly for use in attaching a post, stanchion, pole, standard, divider, delineator, or the like, to a fixed base.

BACKGROUND OF THE INVENTION

Cities often have a need for a temporary sign that can be used to alert drivers as to when it is unacceptable to park their vehicles at a particular location, e.g., due to a parade, construction work, vehicle loading/unloading, etc. In the past, traditional parking meters were available on which workers could place "No Parking" hoods or covers. These meters are being eliminated in many cities in favor of single, centrally located parking pay stations.

Thus, a need exists for a temporary structure to support a sign or other indicator at a particular height and location. To meet this need, a preferred arrangement would be capable of attaching a post, stanchion, pole, standard, or the like, to a fixed base. Ideally, the structure would be easy to install and remove by authorized personnel, but difficult to disturb by unauthorized persons. In addition, it would be advantageous for some applications, if the device could preferably withstand the impact of being inadvertently hit by a vehicle. The present invention is directed to fulfilling these needs and others as described below.

SUMMARY OF THE INVENTION

In accordance with aspects of the present invention, a removable assembly for use on a fixed surface is described. The assembly includes a post with a base and an attachment assembly. In one embodiment, the post is a self-righting impact-recovery post. An optional shroud is available for placement between the attachment plate and the base of the post.

The attachment assembly includes a base plate capable of carrying a magnetic current and capable of engaging the fixed surface. The a magnet assembly includes a housing and a magnet disposed within the housing. The housing is formed of a magnetizable material and includes an upper wall with an outer surface. As formed, magnetic current from the magnet causes an attractive force between the housing and the base plate, the magnet itself being positioned apart from the base plate while the housing contacts the base plate. An attachment plate is attached to the housing upper wall, adjacent its outer surface. The attachment plate includes one or more outwardly projecting attachment bolts. These bolts engage the base of the post, as assembled.

In accordance with other aspects of this invention, in another embodiment, the magnet is a ring magnet and the housing has a circular cup shape. Alternatively, an arrangement is described in which the magnet is a bar magnet and the housing has a rectangular channel shape. As assembled, the bar magnet is located colinearly in the housing. Further configurations may be formed in which multiple bar magnets and channel housings are used, each having a unique orientation.

In accordance with further aspects of this invention, the base plate includes an opening and the attachment plate includes a bolt extending downward from the attachment plate, through the magnet assembly, and engaging the opening of the base plate. During use, this engagement helps to maintain the attachment plate and magnet assembly on the base plate.

BRIEF DESCRIPTION OF THE DRAWINGS

The foregoing aspects and many of the attendant advantages of this invention will become more readily appreciated by reference to the following detailed description, when taken in conjunction the the accompanying drawings, wherein.

DETAILED DESCRIPTION OF THE PREFERRED EMBODIMENT

Figure 1:
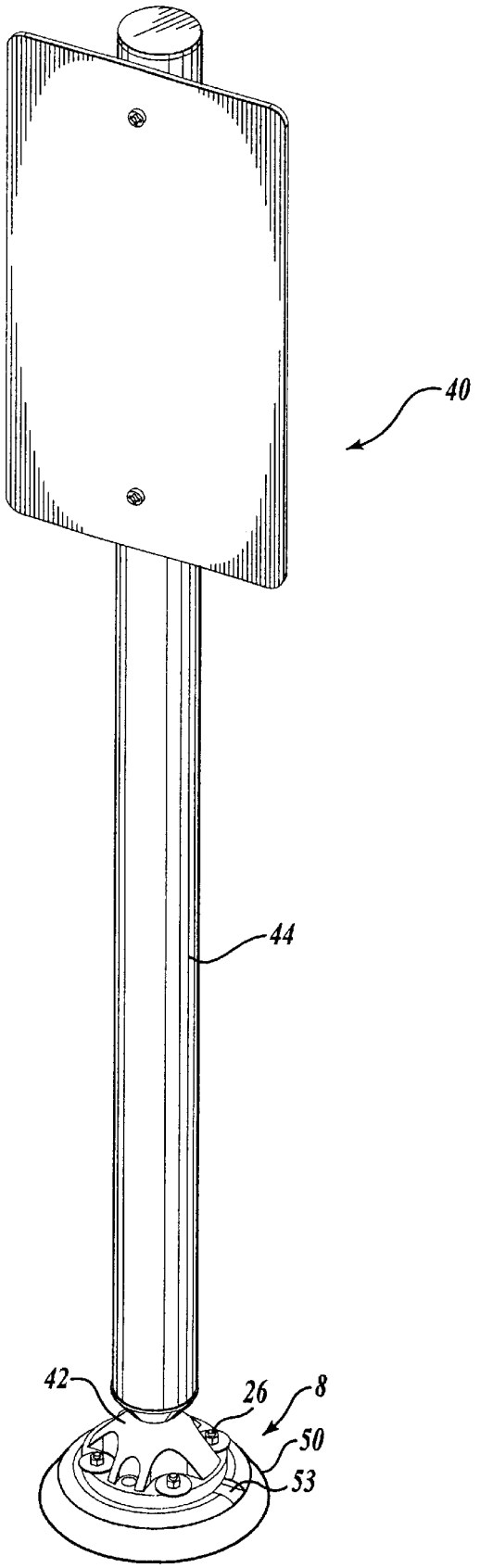
FIG. 1 is a perspective view of a separable magnetic attachment assembly formed in accordance with the present invention.

Referring to FIG. 1, the present invention is an attachment assembly 8 particularly useful for securing a post, stanchion, pole, standard, or the like, to a fixed base. As used herein, the term "post" is used generally to mean any type of temporary object, and particularly elongated objects. Examples include posts that hold signs, posts used in sports applications, and posts used in creating temporary fences or barriers. Numerous other applications are possible. As delineated by the claims, the assembly may also be used with other objects (elongated or otherwise) for which it is desirable to have a quick and easy means of separably attaching the object to a base.

Figure 2A:
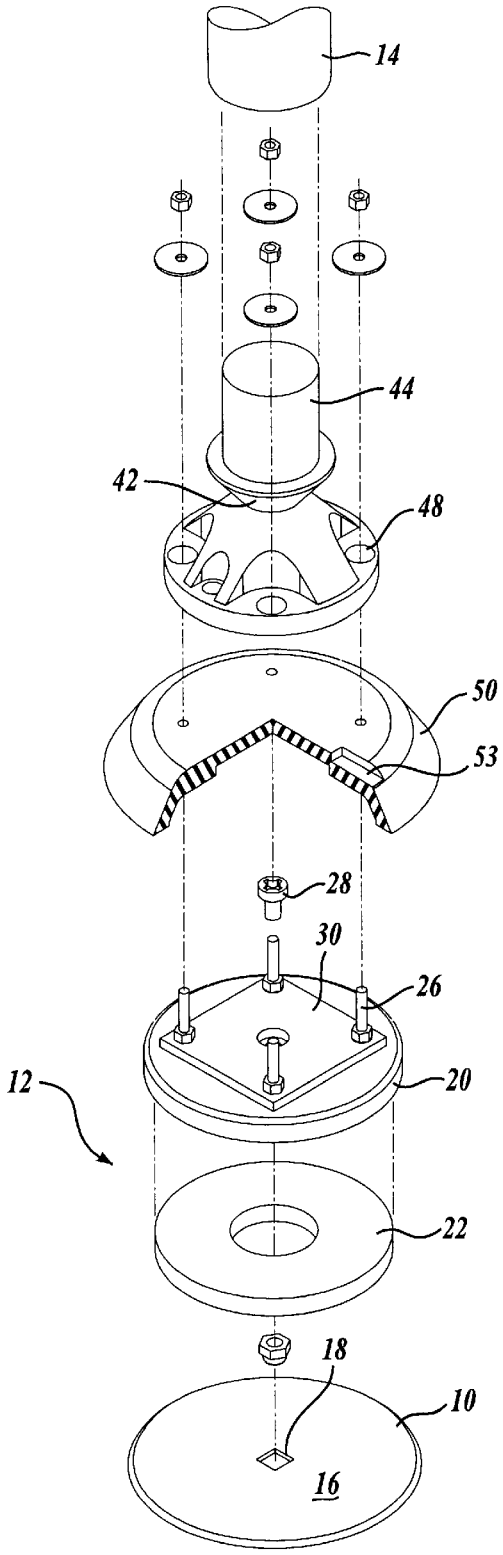
FIG. 2 is an exploded detail view with a partial cutaway section of one embodiment of an assembly formed in accordance with the present invention.
FIG. 2B is an exploded detail view of another embodiment of an assembly formed in accordance with the present invention.
Figure 2B:
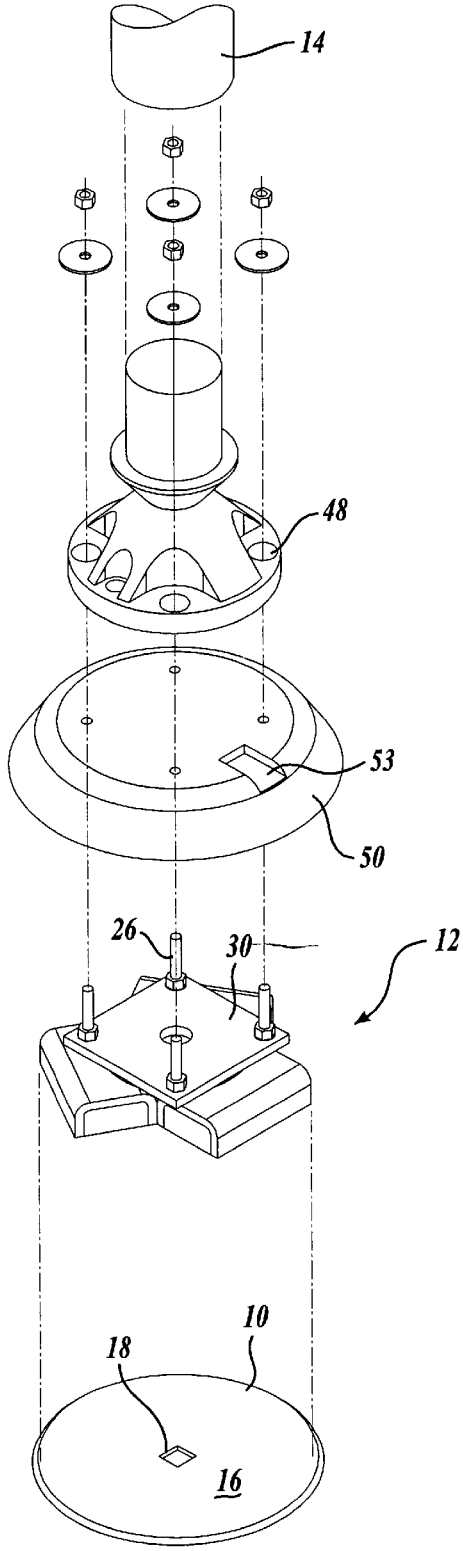

Referring to FIGS. 2A and 2B, the assembly includes a base plate 10 and a magnet assembly 12. A post or other object is connectable to the magnet assembly, preferably in a manner that one is separable from the other. In these embodiments, the base plate is a circular steel disc having a beveled outer periphery. It is approximately 5 inches in diameter and 3/16-inch in thickness. The base plate is permanently adhered to (or formed into) a sidewalk or other hard smooth surface. The upper surface 16 of the base plate 10 is preferably made of a nonskid material. This is particularly useful if there is a need to meet safety standards for public use. The base plate 10 includes an opening 18 at its center. In one embodiment, the opening is a ½-inch by ½-inch square.

Figure 3:
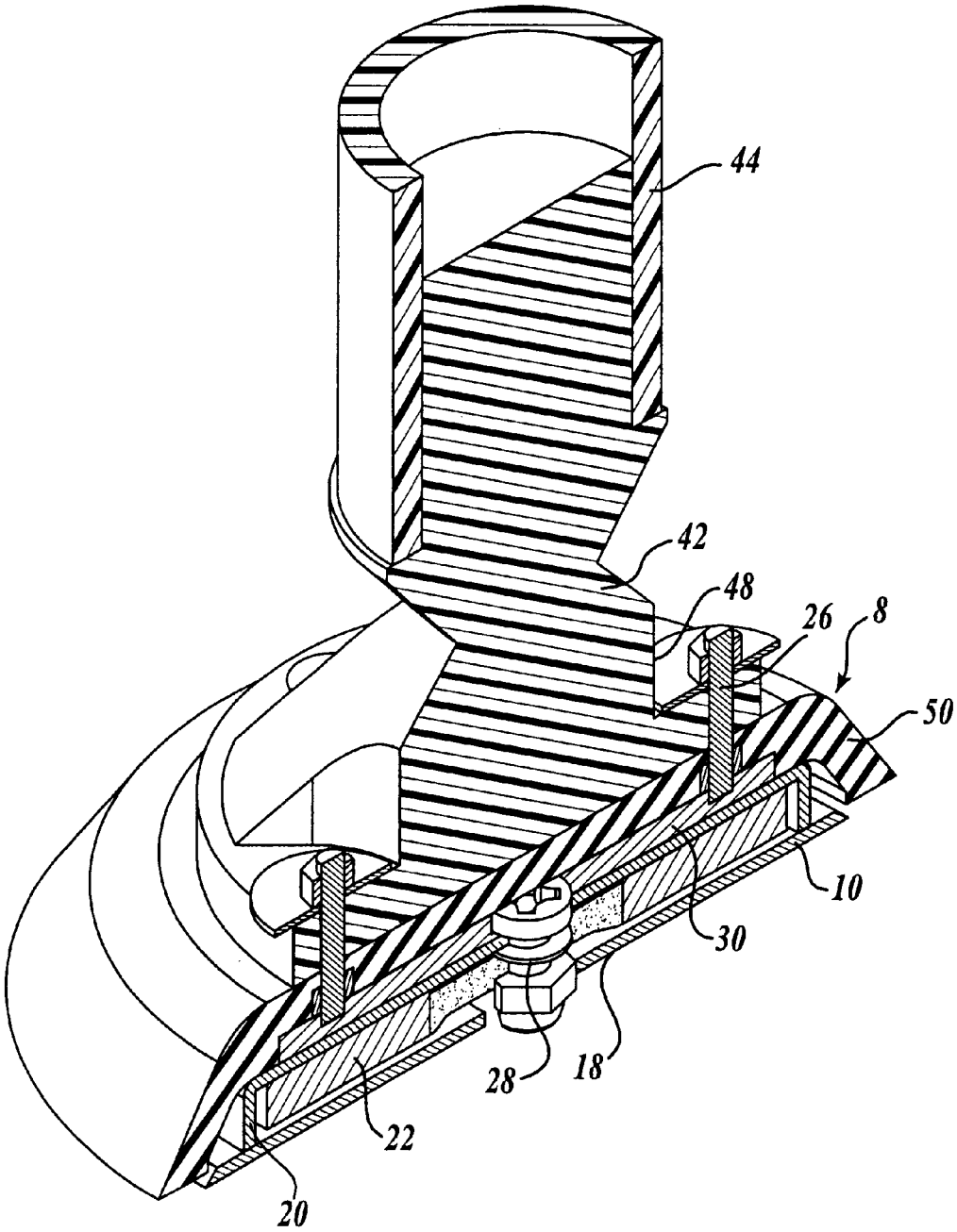
FIG. 3 is a cross-sectional side view of the embodiment of FIG. 2A.
Figure 4:
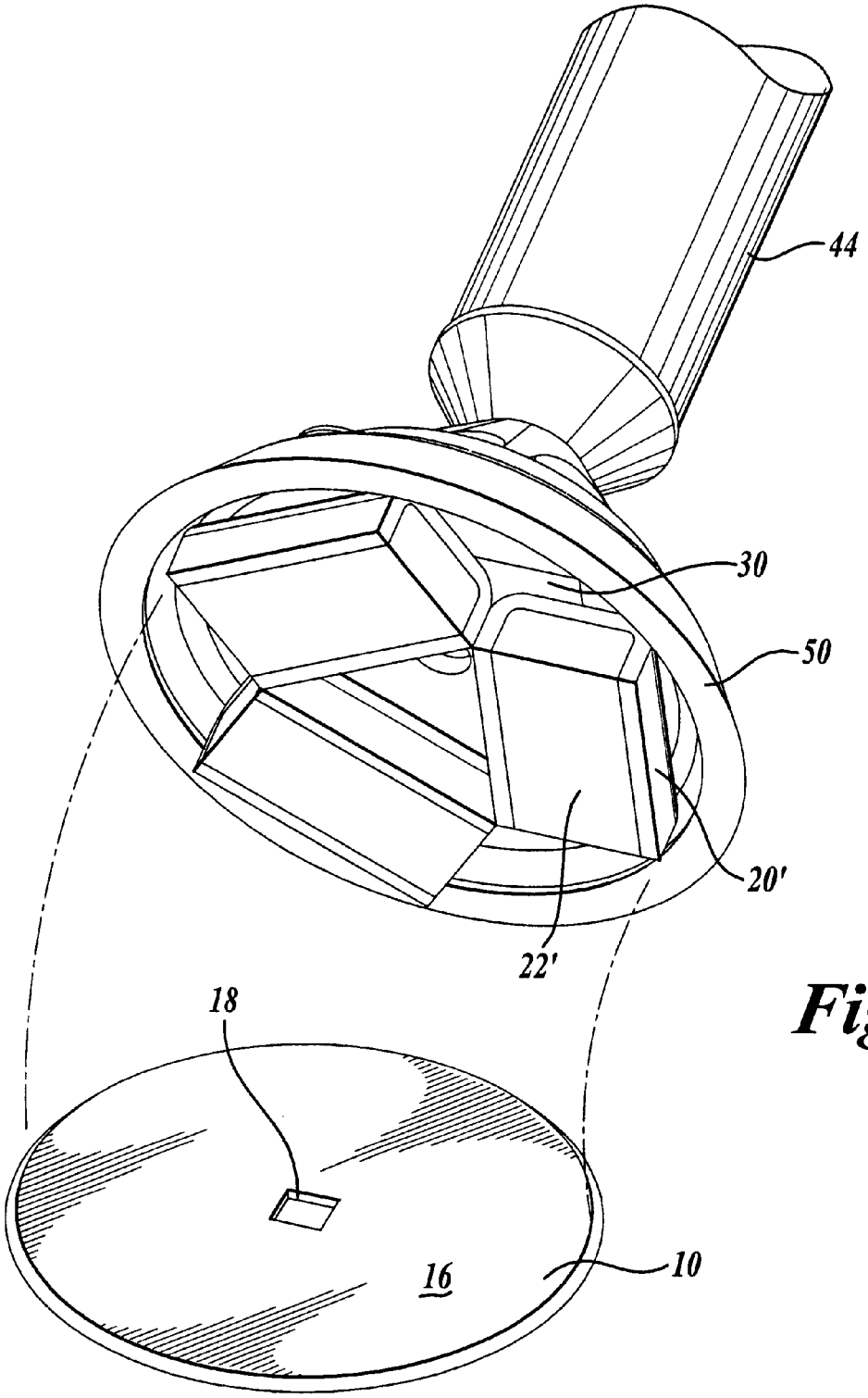
FIG. 4 is a perspective view further illustrating the embodiment of FIG. 2B.

In the arrangements of FIGS. 2A and 3, the magnet assembly 12 includes a cup-shaped metal housing 20 and a ring magnet 22. The ring magnet 22 is adhered onto the upper inside surface of the housing. The lower portion of the housing is open. In this way, the housing has a shallow upside-down bowl shape. The upper surface of the housing includes a number of upwardly extending attachment bolts 26. A central bolt 28 extends downwardly from the middle of the housing. In the embodiment shown, the attachment bolts 26 and the central bolt 28 are formed on opposite sides of an attachment plate 30. An opening in the center of the housing allows the central bolt to extend downward therethrough. As will be appreciated from those skilled in the art, other configurations are possible.

In FIG. 2B, the magnet assembly 12 includes separate U-shaped housings 20' that each contain their own magnet 22'. The housings 20' face downward, end-to-end, in a circular arrangement. An attachment plate 30 is connected to the upper surfaces of the housings. One of the advantages of the arrangement of FIG. 2B is that it provides a magnetic arrangement that is difficult to accidentally remove from the base plate. Because the magnets are provided in opposing orientations, shearing forces are minimized. This further allows the use of particularly strong magnets, such as rare-earth magnets (e.g., neodymium magnets).

In either arrangement, the housing is preferably made of a material that can carry a magnetic current, e.g., steel. This allows the housing to attract and attach to the base plate during use, as opposed to the magnet or magnets attaching directly to the base plate. In general, such arrangement is referred to as a "cup magnet" arrangement, since it is the "cup" itself that is physically connected to a magnetic surface.

In some embodiments, the strength of the magnets will be significant. If such magnets are attached directly to the base plate, the task of manually separating these parts may become too difficult for the average user. In FIG. 2A, the notch 34 is available in the assembly housing to allow a user to pry the magnet assembly from the base plate. The ring magnet is preferably formed of a rare-earth or ceramic material.

As mentioned above, the attachment assembly of the present invention is particularly useful for separably connecting a post 14 to a fixed base. In FIG. 1, a sign 40 is shown releasably connected to a sidewalk. In this arrangement, the preferred post is a conventional impact-recovery post. The impact-recovery post includes a spring-loaded base 42 and an upright pole 44. The base 42 includes a number of boltholes 48 positioned to align with the magnet assembly's attachment bolts.

To assemble the sign of FIG. 1, the base 42 is bolted onto the attachment bolts 26, with an optional rubber shroud 50 positioned therebetween. The combination is then lowered onto the base plate 10 that is adhered to the sidewalk, or other essentially smooth solid surface. In this embodiment, the magnet 22 does not directly touch the base plate 10. Magnetic forces between the lower edges of the housing 20 and the base plate 10 are sufficient to maintain the magnet assembly on the base plate. An opening 53 in the shroud is available for use in peeling the magnet assembly from the base plate. See FIG. 2A. A lever-type prying device is inserted into the opening 53 and rotatable about a fulcrum contacting the adjacent ground. The user pries the magnet assembly away from the base plate.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A removable assembly for use on a fixed surface, the assembly comprising:

(a) a post; and (b) an attachment assembly including (i) a base plate capable of carrying a magnetic current and capable of engaging the fixed surface; and (ii) a magnet assembly including a housing connected to the post and a magnet disposed within the housing; the housing being formed of a material capable of carrying a magnetic current; wherein during use, the housing contacts the base plate so that magnetic current from the magnet causes an attractive force between the housing and the base plate, the magnet itself being positioned apart from the base plate.

2. The assembly according to claim 1, wherein the post includes a base having at least one opening and housing includes a lateral upper wall with an outer surface; the assembly further comprising an attachment plate attached to the housing upper wall adjacent its outer surface the attachment plate including at least one outwardly projecting attachment bolt; wherein, as assembled, the at least one attachment bolt engages the at least one opening of the base.

3. The assembly according to claim 2, wherein the base includes at least four openings and the attachment plate includes at least four outwardly projecting attachment bolts adapted to engage the at least four openings of the base.

4. The assembly according to claim 2, further comprising a shroud located between the attachment plate and the post base; the shroud including at least one opening through which the at least one attachment bolt extends.

5. The assembly according to claim 1, wherein the magnet is a ring magnet and the housing has a circular cup shape; wherein as assembled, the ring magnet is located coaxially in the housing.

6. The assembly according to claim 2, wherein the attachment plate is welded to the upper wall of the housing.

7. The assembly according to claim 1, wherein the magnet is a bar magnet and the housing has a rectangular channel shape; wherein as assembled, the bar magnet is located colinearly in the housing.

8. The assembly according to claim 7, wherein the magnet assembly includes at least three bar magnets positioned within separate rectangular housings, the housings being arranged in differing orientations to follow a generally circular path.

9. The assembly according to claim 7, wherein the attachment plate is welded to the upper wall of the housing.

10. The assembly according to claim 1, wherein the post is an impact-recovery post capable of self-righting after impact.

11. The assembly according to claim 1, wherein the magnet is adhered to the inside of the housing.

12. The assembly according to claim 1, wherein the base plate is made of a material including at least steel.

13. The assembly according to claim 1, wherein the base plate includes an upper surface with an opening and the assembly further includes a bolt extending downward from the housing and engaging the opening of the base plate; wherein during use, this engagement helps to maintain the attachment plate and magnet assembly on the base plate.

14. The assembly according to claim 1, wherein the attachment assembly includes an opening capable of receiving a prying device for use in releasing the magnet assembly from the base plate.

15. A removable assembly for use on a fixed surface, the assembly comprising:

(a) an impact-recovery post having a base, the base including a number of openings; and (b) an attachment assembly including (i) a base plate capable of carrying a magnetic current and capable of engaging the fixed surface;

(ii) a magnet assembly including a housing and a magnet disposed within the housing; the housing being formed of a magnetizable material and including an upper wall with an outer surface; wherein as joined, magnetic current from the magnet causes an attractive force between the housing and the base plate, the magnet itself being positioned apart from the base plate while the housing contacts the base plate; and (iii) an attachment plate attached to the housing upper wall adjacent its outer surface; the attachment plate including a number of outwardly projecting attachment bolts; wherein, as assembled, the attachment bolts engage and are fixedly held within the openings of the post base.

16. The assembly according to claim 10, wherein the magnet assembly remains attached to the base plate upon impact to the post.

17. The assembly according to claim 1, wherein the magnet assembly is capable of remaining attached to the base plate upon impact to the post.

18. The assembly according to claim 1, further comprising means for limiting lateral movement of the magnet assembly relative to the base plate.

19. The assembly according to claim 1, wherein the base plate is a flat disc with an upper surface, the housing contacting the upper surface during use.

20. The assembly according to claim 19, wherein the outer edges of the base plate are beveled.

21. A removable assembly for use on a fixed surface, the assembly comprising:

(a) an impact-recovery post having a base, the base including a number of openings; and (b) an attachment assembly including (i) a flat base plate with an upper surface, the base plate capable of carrying a magnetic current and capable of attachment to the fixed surface;

(ii) a magnet assembly including a housing and a permanent magnet disposed within the housing; during use, an attractive force existing between the magnet assembly and the base plate thereby maintaining one to the other; and (iii) an attachment plate attached to the housing and including a number of outwardly projecting attachment bolts; wherein, as assembled, the attachment bolts engage and are fixedly held within the openings of the post base.

* * * * *